US009626903B2

(12) United States Patent
Kim et al.

(10) Patent No.: US 9,626,903 B2
(45) Date of Patent: Apr. 18, 2017

(54) ORGANIC LIGHT-EMITTING DIODE (OLED) DISPLAY PANEL FOR DECREASING OFF-LEAKAGE CURRENT AND OLED DISPLAY HAVING THE SAME

(71) Applicant: Samsung Display Co., Ltd., Yongin, Gyeonggi-Do (KR)

(72) Inventors: Soon-Dong Kim, Osan-si (KR); Yang-Hwa Choi, Suwon-si (KR); Cheol-Min Kim, Seongnam-si (KR); Hyung-Ryul Kang, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/195,654

(22) Filed: Mar. 3, 2014

(65) Prior Publication Data

US 2014/0333597 A1 Nov. 13, 2014

(30) Foreign Application Priority Data

May 7, 2013 (KR) ..... 10-2013-0051287

(51) Int. Cl.
*G09G 3/30* (2006.01)
*G09G 3/3233* (2016.01)

(52) U.S. Cl.
CPC ... *G09G 3/3233* (2013.01); *G09G 2300/0852* (2013.01)

(58) Field of Classification Search
CPC ..... G09G 3/12–3/14; G09G 3/30–3/3291
See application file for complete search history.

(56) References Cited

U.S. PATENT DOCUMENTS

2004/0080475 A1* 4/2004 Yoshida ..... G09G 3/3233 345/82
2007/0064469 A1* 3/2007 Umezaki ..... G09G 3/325 365/154
2010/0039411 A1* 2/2010 Yatabe ..... G09G 3/3233 345/204
2011/0279484 A1* 11/2011 Han ..... G09G 3/3233 345/690
2012/0127221 A1* 5/2012 Tamaki ..... G09G 3/3233 345/691

FOREIGN PATENT DOCUMENTS

KR 10-2006-0114470 A 11/2006
KR 10-2007-0019463 A 2/2007
KR 10-2012-0074422 A 7/2012

* cited by examiner

*Primary Examiner* — Sanghyuk Park
(74) *Attorney, Agent, or Firm* — Knobbe Martens Olson & Bear LLP

(57) ABSTRACT

An organic light-emitting diode (OLED) display panel is disclosed. In one aspect, the panel includes a first transistor which receives a data signal transferred through a data line in response to a scan signal transferred through a gate line and a second transistor which receives a first power signal in response to a bias signal and outputs a source-driving signal. The panel also includes a third transistor which receives the source-driving signal in response to an output signal of the first transistor and outputs a driving signal, an organic light-emitting element which comprises a first electrode being connected to the third transistor and which receives the driving signal and a second electrode which receives a second power signal. The panel further includes a fourth transistor which is electrically connected to the third transistor and which receives the driving signal.

9 Claims, 4 Drawing Sheets

ORGANIC LIGHT-EMITTING DIODE (OLED) DISPLAY PANEL FOR DECREASING OFF-LEAKAGE CURRENT AND OLED DISPLAY HAVING THE SAME

CROSS-REFERENCE TO RELATED APPLICATIONS

This application claims priority under 35 USC §119 to Korean Patent Applications No. 10-2013-0051287, filed on May 7, 2013 in the Korean Intellectual Property Office KIPO, the contents of which are incorporated herein in its entirety by reference.

BACKGROUND

Field

The described technology relates generally to an organic light-emitting diode (OLED) display panel and an OLED display including the panel. More particularly, embodiments of the described technology relate to an OLED display panel which can increase the contrast ratio and an OLED display including the panel.

Description of the Related Technology

Generally, an OLED display panel includes a plurality of organic light-emitting elements respectively corresponding to a plurality of sub-pixels.

Each organic light-emitting element or OLED includes two electrodes and an organic light-emitting layer. The organic light-emitting layer is disposed between the two electrodes and emits by producing an electric field between the electrodes. One of the electrodes is a transparent electrode so that the organic light-emitting element emits light to through the transparent electrode in order to display an image. Generally, the organic light-emitting element is driven in a current driving mode.

The OLED display panel includes an organic light-emitting element and two transistors which are electrically connected to the element for driving.

Currently, each element includes an organic light-emitting layer having a high efficiency emitting material so that luminance can be increased using a small current of several pA (pico-Ampere). Therefore, black luminance corresponding to a black image or image portion is increased and consequently the contrast ratio decreases.

SUMMARY OF CERTAIN INVENTIVE ASPECTS

One inventive aspect is an OLED display panel capable of increasing a contrast ratio.

Another aspect is an OLED display including the panel.

Another aspect is an organic light-emitting display panel (hereinafter to be interchangeably used with an OLED display panel) which includes a first transistor which receives a data signal transferred through a data line in response to a scan signal transferred through a gate line, a second transistor which receives a first power signal in response to a bias signal and outputs a source-driving signal, a third transistor which receives the source-driving signal in response to an output signal of the first transistor and outputs a driving signal, an organic light-emitting element which comprises a first electrode being electrically connected to the third transistor and which receives the driving signal and a second electrode which receives a second power signal, and a fourth transistor which is electrically connected to the third transistor and which receives the driving signal.

In exemplary embodiments, the fourth transistor may include a control electrode, an input electrode and an output electrode, the input electrode being electrically connected to the third transistor, the output electrode receives a control power signal.

In exemplary embodiments, the control electrode of the fourth transistor may receive the first power signal.

In exemplary embodiments, the control electrode of the fourth transistor may receive the scan signal.

In exemplary embodiments, the control power signal may be the second power signal.

In exemplary embodiments, the bias signal may have a level which is selectively determined depending on a dimming mode.

In exemplary embodiments, the OLED display panel may further include a first capacitor which comprises a first electrode which receives the first power signal and a second electrode which receives the output signal of the first transistor, and a second capacitor which comprises a first electrode which receives the first power signal and a second electrode which receives the bias signal.

According to exemplary embodiments, an organic light-emitting display panel may include a first transistor which receives a data signal transferred through a data line in response to a scan signal transferred through a gate line, a second transistor which receives a first power signal in response to a bias signal and outputs a source-driving signal, a third transistor which has a dual-gate structure, receives the source-driving signal in response to an output signal of the first transistor and outputs a driving signal, and an organic light-emitting element which comprises a first electrode being electrically connected to the third transistor and which receives the driving signal and a second electrode which receives a second power signal.

In exemplary embodiments, the organic light-emitting display panel may further include a first capacitor which comprises a first electrode which receives the first power signal and a second electrode which receives the output signal of the first transistor, and a second capacitor which comprises a first electrode which receives the first power signal and a second electrode which receives the bias signal.

In exemplary embodiments, the bias signal may have a level which is selectively determined depending on a dimming mode.

Another aspect is an organic light-emitting display device (hereinafter to be interchangeably used with an OLED display) which includes an organic light-emitting display panel which comprises a first transistor being electrically connected to a gate line and a data line, a second transistor which receives a first power signal in response to a bias signal and outputs a source-driving signal, a third transistor which receives the source-driving signal in response to an output signal of the first transistor and outputs a driving signal, an organic light-emitting element comprising a first electrode being electrically connected to the third transistor in order to receive the driving signal and a second electrode which receives a second power signal, and a fourth transistor being electrically connected to the third transistor which receives the driving signal, a gate driving part providing the gate line with a scan signal, a data driving part providing the data line with a data signal and a voltage generating part generating the first power signal, the second power signal, the bias signal and a control power signal.

In exemplary embodiments, the fourth transistor may include a control electrode, an input electrode and an output electrode, the input electrode being electrically connected to the third transistor, the output electrode receives the control power signal.

In exemplary embodiments, the control electrode of the fourth transistor may receive the first power signal.

In exemplary embodiments, the control electrode of the fourth transistor may receive the scan signal.

In exemplary embodiments, the control power signal may be the second power signal.

In exemplary embodiments, the organic light-emitting display panel may further include a first capacitor which comprises a first electrode which receives the first power signal and a second electrode which receives the output signal of the first transistor, and a second capacitor which comprises a first electrode which receives the first power signal and a second electrode which receives the bias signal.

In exemplary embodiments, the bias signal may have a level which is selectively determined depending on a dimming mode.

Another aspect is an organic light-emitting display device may include an organic light-emitting display panel which comprises a first transistor being electrically connected to a gate line and a data line, a second transistor which receives a first power signal in response to a bias signal and outputs a source-driving signal, a third transistor having a dual-gate structure, which receives the source-driving signal in response to an output signal of the first transistor and outputs a driving signal, and an organic light-emitting element comprising a first electrode being electrically connected to the third transistor and which receives the driving signal and a second electrode which receives a second power signal, a gate driving part providing the gate line with a scan signal, a data driving part providing the data line with a data signal; and a voltage generating part generating the first power signal, the second power signal and the bias signal.

In exemplary embodiments, the organic light-emitting display panel may further include a first capacitor which comprises a first electrode which receives the first power signal and a second electrode which receives the output signal of the first transistor and a second capacitor which comprises a first electrode which receives the first power signal and a second electrode which receives the bias signal.

In exemplary embodiments, the bias signal may have a level which is selectively determined depending on a dimming mode.

According to at least one of exemplary embodiments of the described technology, the off-leakage current flowing through the organic light-emitting element may be decreased so that the contrast ratio may be increased.

BRIEF DESCRIPTION OF THE DRAWINGS

The disclosed embodiments are intended to be illustrative to facilitate a clear understanding of the following detailed description taken in conjunction with the accompanying drawings and are not intended to be limited thereto.

DETAILED DESCRIPTION OF CERTAIN INVENTIVE EMBODIMENTS

Figure 1:
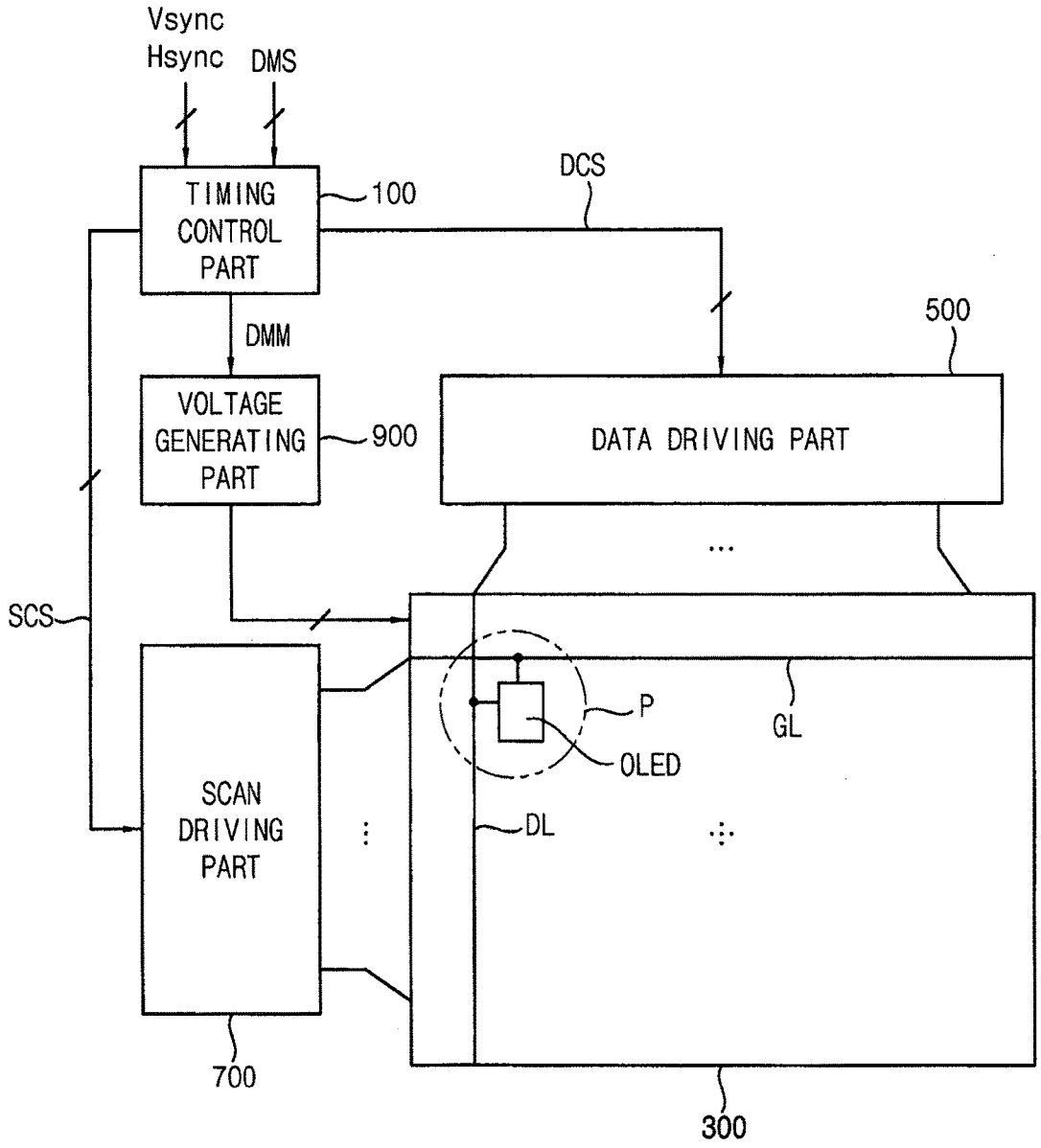
FIG. 1 is a block diagram illustrating an organic light-emitting display device according to exemplary embodiments.

Various embodiments will be described more fully hereinafter with reference to the accompanying drawings, in which exemplary embodiments are shown. The described technology may, however, be embodied in many different forms and should not be construed as limited to the exemplary embodiments set forth herein. Rather, these exemplary embodiments are provided so that this disclosure will be thorough and complete, and will fully convey the scope of the described technology to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the described technology. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular exemplary embodiments only and is not intended to be limiting of the described technology. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the described technology belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the described technology will be explained in detail with reference to the accompanying drawings.

Figure 2:
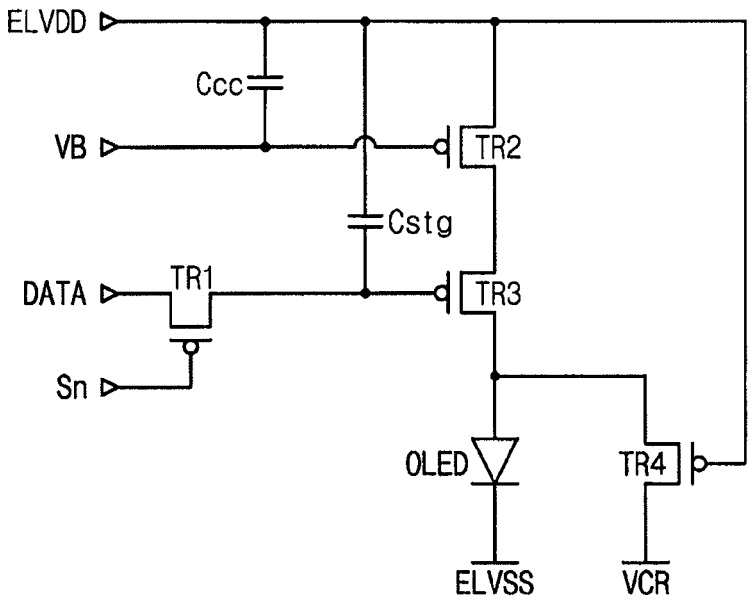
FIG. 2 is an equivalent circuit illustrating a sub-pixel as shown in FIG. 1.

FIG. 1 is a block diagram illustrating an organic light-emitting display device according to exemplary embodiments. FIG. 2 is an equivalent circuit illustrating a sub-pixel as shown in FIG. 1.

In reference to FIGS. 1 and 2, the organic light-emitting display device may include a timing control part 100, an organic light-emitting display panel 300, a data driving part 500, a scan driving part 700 and a voltage generating part 900.

The timing control part 100 generates a scan control signal SCS and a data control signal DCS using vertical and horizontal synchronization signals Vsync and Hsync. The timing control part 100 provides the scan driving part 700 with the scan control signal SCS and provides the data driving part 500 with the data control signal DCS. In addition, the timing control part 100 generates a dimming control signal DMM based on a dimming mode signal DMS and may provide the voltage generating part 900 with the dimming control signal DMM. The voltage generating part 900 may control a level of a bias signal VB applied to the organic light-emitting display panel 300 based on the dimming control signal DMM.

The organic light-emitting display panel 300 may include a plurality of data lines DL, a plurality of gate lines GL and a plurality of sub-pixels P. Each of the sub-pixels P includes an organic light-emitting element OLED. According to the present exemplary embodiment, an equivalent circuit of the sub-pixel P, as shown in FIG. 2, includes a first transistor TR1, a second transistor TR2, a third transistor TR3, a fourth transistor TR4 and the organic light-emitting element OLED. In addition, the sub-pixel P may further include a storage capacitor Cstg and a coupling capacitor Ccc.

The data driving part 500 converts image data to a data voltage using a reference gamma voltage based on the data control signal DCS received from the timing control part 100. The data driving part 500 provides the data line DL of the organic light-emitting display panel 300 with the data voltage.

The scan driving part 700 generates a scan signal based on the scan control signal SCS received from the timing control part 100. The scan driving part 700 sequentially provides the gate lines GL with the scan signal.

The voltage generating part 900 provides the organic light-emitting display panel 300 with the bias signal VB, a control power signal VCR, a first power signal ELVDD and a second power signal ELVSS. The bias signal VB may have a level which is selectively determined depending on the dimming mode and is applied to a control electrode of the second transistor TR2.

The control power signal VCR may be substantially the same as the second power signal ELVSS and is applied to an output electrode of the fourth transistor TR4. The first power signal ELVDD is applied to an input electrode of the second transistor TR2 through a voltage line VL. The second power signal ELVSS is applied to a cathode electrode of the organic light-emitting element OLED.

Hereinafter, the sub-pixel P will be explained in reference to FIG. 2.

The sub-pixel P may include a first transistor TR1, a second transistor TR2, a third transistor TR3, a fourth transistor TR4, an organic light-emitting element OLED, a storage capacitor Cstg and a coupling capacitor Ccc.

The first transistor TR1 includes a control electrode connected to the gate line GL, an input electrode connected to the data line DL and an output electrode connected to the third transistor TR3. The first transistor TR1 receives the data voltage through the data line DL in response to the scan signal through the gate line GL.

The second transistor TR2 includes a control electrode which receives the bias signal VB, an input electrode which receives the first power signal ELVDD and an output electrode connected to the third transistor TR3. The second transistor TR2 receives the first power signal ELVDD in response to the bias signal VB and outputs a source-driving signal.

For example, the bias signal VB may have the level which is selectively determined depending on, the dimming mode. According to a potential difference between the bias signal VB applied to the control electrode of the second transistor TR2 and the first power signal ELVDD, an output current of the second transistor TR2 may be controlled. In other words, a peak level of a current applied to the organic light-emitting element OLED may be controlled.

The bias signal VB and the first power signal ELVDD in a normal luminance dimming mode has a first potential difference. The bias signal VB and the first power signal ELVDD in a low luminance dimming mode may have a second potential difference less than the first potential difference. Thus, in the normal luminance dimming mode, a current of a first peak level may be applied to the organic light-emitting element OLED. In the low luminance dimming mode, a current of a second peak level less than the first peak level may be applied to the organic light-emitting element OLED.

The third transistor TR3 includes a control electrode connected to the first transistor TR1, an input electrode connected to the second transistor TR2 and an output electrode connected to the organic light-emitting element OLED. The third transistor TR3 receives the source-driving signal received from the second transistor TR2 in response to an output signal of the first transistor TR1 and outputs a driving signal.

The organic light-emitting element OLED includes a first electrode connected to the third transistor TR3 in order to receive the driving signal and a second electrode which receives the second power signal ELVSS.

The fourth transistor TR4 includes a control electrode which receives the first power signal ELVDD, an input electrode connected to the output electrode of the third transistor TR3 and an output electrode which receives the control power signal VCR. The control power signal VCR is a direct current such as the second power signal ELVSS. Alternatively, the control power signal VCR may be changed by a threshold voltage VTH of a transistor formed in the organic light-emitting display panel 300.

The fourth transistor TR4 receives the driving signal that is an output signal of the third transistor TR3, in response to the first power signal ELVDD.

The driving signal that is the output signal of the third transistor TR3, is separately applied to the fourth transistor TR4 and the organic light-emitting element OLED. Thus, the current applied to the organic light-emitting element OLED may be decreased.

According to the present exemplary embodiment, a black data voltage is applied to the control electrode of the third transistor TR3 during a period in which the first transistor TR1 is turned on in response to the scan signal Sn, so that the sub-pixel P displays a black image. The third transistor TR3 is substantially turned off by the black data voltage. At this time, an off-leakage current of the third transistor TR3 separately flows to the fourth transistor TR4 which is turned on and to the organic light-emitting element OLED. Thus, when the sub-pixel P displays a black image, the off-leakage current applied to the organic light-emitting element OLED having a high efficiency emitting layer may be decreased so that a black luminance of the black image displayed on the sub-pixel P may be decreased.

According to the present exemplary embodiment, when the sub-pixel P displays a white image, a white luminance of the organic light-emitting element OLED may also be decreased. However, the organic light-emitting element OLED has a high efficiency emitting layer so that a white luminance of the white image may be substantially the same as that of a white image displayed on a sub-pixel P which does not include a fourth transistor TR4. As a result, when the sub-pixel P displays the black image, the current flowing through the organic light-emitting element OLED may be decreased so that the black luminance may be decreased. Thus, the off-leakage current flowing through the organic light-emitting element OLED may be decreased so that a contrast ratio may be increased.

The storage capacitor Cstg includes a first electrode which receives the first power signal ELVDD and a second electrode electrically connected to the control electrode of the third transistor TR3.

The coupling capacitor Ccc includes a first electrode which receives the first power signal ELVDD and a second electrode electrically connected to the control electrode of the second transistor TR2.

When the gate line GL receives the scan signal, the first transistor TR1 is turned on and the data voltage transferred through the data line DL is applied to the control electrode of the third transistor TR3. Thus, the third transistor TR3 is turned on.

However, the source-driving signal, which is an output signal of the second transistor TR2, is determined by a potential difference between the bias signal VB applied to the control electrode of the second transistor TR2 and the first power signal ELVDD applied to the input electrode of the second transistor TR2. When the third transistor TR3 is turned on, the driving signal output from the third transistor TR3 is separately applied to the organic light-emitting element OLED and the fourth transistor TR4 . The level of the bias signal VB may control the peak level of the current applied to the organic light-emitting element OLED and the third transistor TR3 may control an emitting period during which the current is applied to the organic light-emitting element OLED.

Figure 3:
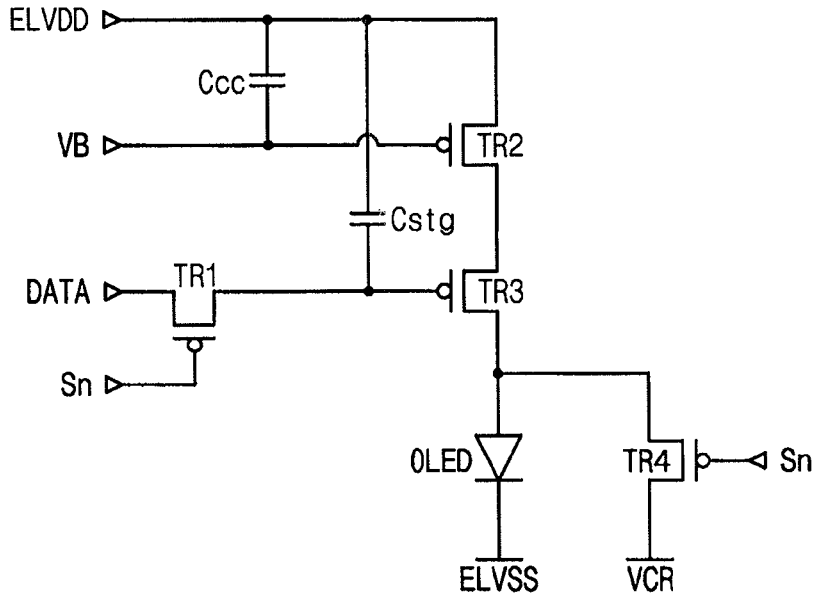
FIG. 3 is an equivalent circuit illustrating a sub-pixel according to exemplary embodiments.

FIG. 3 is an equivalent circuit illustrating a sub-pixel according to exemplary embodiments.

According to the present exemplary embodiment, the sub-pixel P is substantially the same as that of the previous exemplary embodiment, except for a signal applied to the control electrode of the fourth transistor TR4. Hereinafter, the same reference numerals are used to refer to the same or like parts as those described in the previous exemplary embodiment, and the same detailed explanations are not repeated unless necessary.

The sub-pixel P may include a first transistor TR1, a second transistor TR2, a third transistor TR3, a fourth transistor TR4, an organic light-emitting element OLED, a storage capacitor Cstg and a coupling capacitor Ccc.

The first transistor TR1 includes a control electrode which is connected to the gate line GL and receives the scan signal Sn, an input electrode which is connected to the data line DL and an output electrode which is connected to the third transistor TR3.

The fourth transistor TR4 includes a control electrode which is connected to the gate line GL and receives the scan signal Sn, an input electrode which is connected to an output electrode of the third transistor TR3 and an output electrode which receives the control power signal VCR.

A data voltage DATA transferred through the data line DL is applied to the third transistor TR3 in response to the scan signal Sn. Then, an output signal of the third transistor TR3 is separately applied to the fourth transistor TR4, which is turned on in response to the scan signal Sn, and the organic light-emitting element OLED. Therefore, a current flowing through the organic light-emitting element OLED may be decreased.

According to the present exemplary embodiment, when the sub-pixel P display a black image, a black data voltage is applied to the control electrode of the third transistor TR3 during a period in which the first transistor is turned on in response to the scan signal Sn and thus, the third transistor TR3 is substantially turned off by the black data voltage. At this time, an off-leakage current of the third transistor TR3 separately flows the fourth transistor TR4, which is turned on in response to the scan signal Sn, and the organic light-emitting element OLED. Thus, when the sub-pixel P displays a black image, the off-leakage current applied to the organic light-emitting element OLED having a high efficiency emitting layer may be decreased so that a black luminance of the black image displayed on the sub-pixel P may be decreased.

According to the present exemplary embodiment, when the sub-pixel P displays a white image, a white luminance of the organic light-emitting element OLED may also be decreased. However, the organic light-emitting element OLED has a high efficiency emitting layer so that a white luminance of the sub-pixel P may be substantially the same as that of a sub-pixel P which does not include a fourth transistor TR4. However, when the sub-pixel P displays the black image, the current flowing through the organic light-emitting element OLED may be decreased so that the black luminance may be decreased. Thus, the off-leakage current flowing through the organic light-emitting element OLED may be decreased so that the contrast ratio may be increased.

Figure 4:
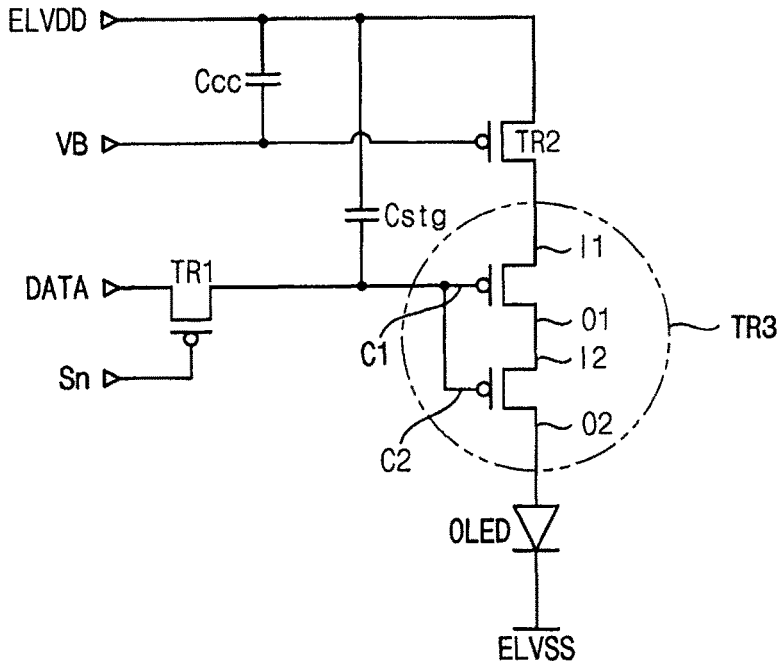
FIG. 4 is an equivalent circuit illustrating a sub-pixel according to exemplary embodiments.

FIG. 4 is an equivalent circuit illustrating a sub-pixel according to exemplary embodiments.

In reference to FIG. 4, according to the present exemplary embodiment, the sub-pixel P may include a first transistor TR1, a second transistor TR2, a third transistor TR3, an organic light-emitting element OLED, a storage capacitor Cstg and a coupling capacitor Ccc. According to the present exemplary embodiment, the sub-pixel P may include the same or like parts as those described in the previous exemplary embodiment, except for the third transistor TR3, and the same detailed explanations are not repeated unless necessary.

The first transistor TR1 includes a control electrode connected to the gate line GL, an input electrode connected to the data line DL and an output electrode connected to the third transistor TR3.

In some embodiments, the third transistor TR3 has a dual-gate structure. The third transistor TR3 may include a first control electrode C1, a second control electrode C2 , a first input electrode I1 , a second input electrode I2 , a first output electrode O1 and a second output electrode O2

The first and second control electrodes C1 and C2 are connected to the first transistor TR1, the first input electrode I1 is connected to the second transistor TR2, the first output electrode O1 is connected to the second input electrode I2, and the second output electrode O2 is connected to the organic light-emitting element OLED.

The second transistor TR2 includes a control electrode which receives the bias signal VB, an input electrode which receives the first power signal ELVDD and an output electrode electrically connected to the third transistor TR3.

A data voltage DATA transferred through the data line DL is applied to first and second control electrodes C1 and C2 of the third transistor TR3 during a period in which the first transistor TR1 is turned on in response to the scan signal Sn. Thus, a driving signal, that is an output signal of the third transistor TR3, may be decreased through the third transistor TR3 having the dual-gate structure. The decreased driving signal is then applied to the organic light-emitting element OLED. Therefore, a current flowing through the organic light-emitting element OLED may be decreased.

According to the present exemplary embodiment, when the sub-pixel P displays a black image, a black data voltage is applied to the third transistor TR3 having the dual-gate structure during a period in which the first transistor TR1 is turned on in response to the scan signal Sn and thus, the third transistor TR3 is substantially turned off in response to the black data voltage. At this time, an off-leakage current of the third transistor TR3 having the dual-gate structure may be relatively decreased, and then the decreased off-leakage current flows through the organic light-emitting element OLED. Thus, when the sub-pixel P displays a black image, the off-leakage current applied to the organic light-emitting element OLED having a high efficiency emitting layer may be decreased so that a black luminance of the black image displayed on the sub-pixel P may be decreased.

According to the present exemplary embodiment, when the sub-pixel P displays a white image, a white luminance of the organic light-emitting element OLED may also be decreased. However, the organic light-emitting element OLED has a high efficiency emitting layer so that a white luminance of the white image may be substantially the same as that of a white image displayed on a sub-pixel P having a single-gate structure third transistor TR3. However, when the sub-pixel P displays the black image, the current flowing through the organic light-emitting element OLED may be decreased so that the black luminance may be decreased. Thus, the off-leakage current flowing through the organic light-emitting element OLED may be decreased so that the contrast ratio may be increased.

Figure 5:
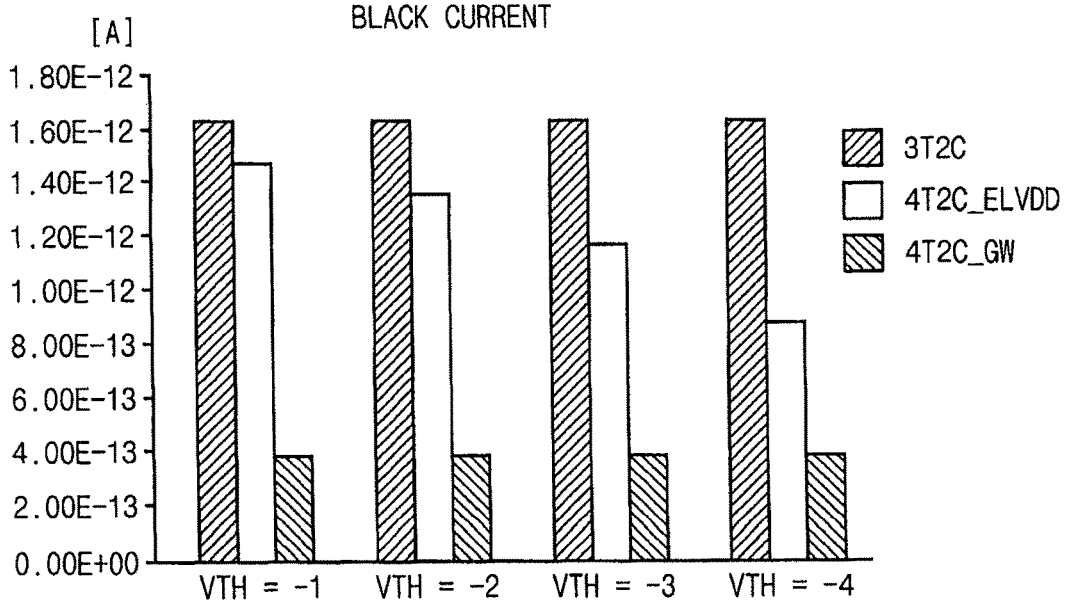
FIG. 5 is a graph diagram illustrating a current flowing through an organic light-emitting element when the sub-pixel displays a black image according to a comparative example embodiment and exemplary embodiments.
Figure 6:
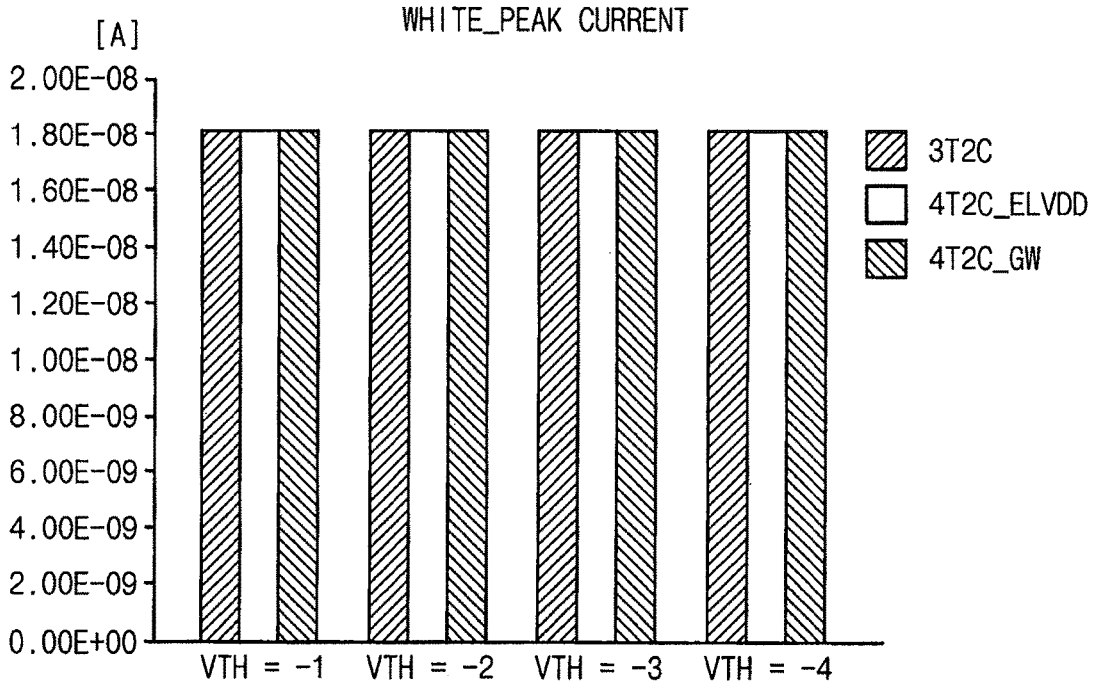
FIG. 6 is a graph diagram illustrating a current flowing through an organic light-emitting element when the sub-pixel displays a white image according to the comparative example embodiment and the exemplary embodiments.
Figure 7:
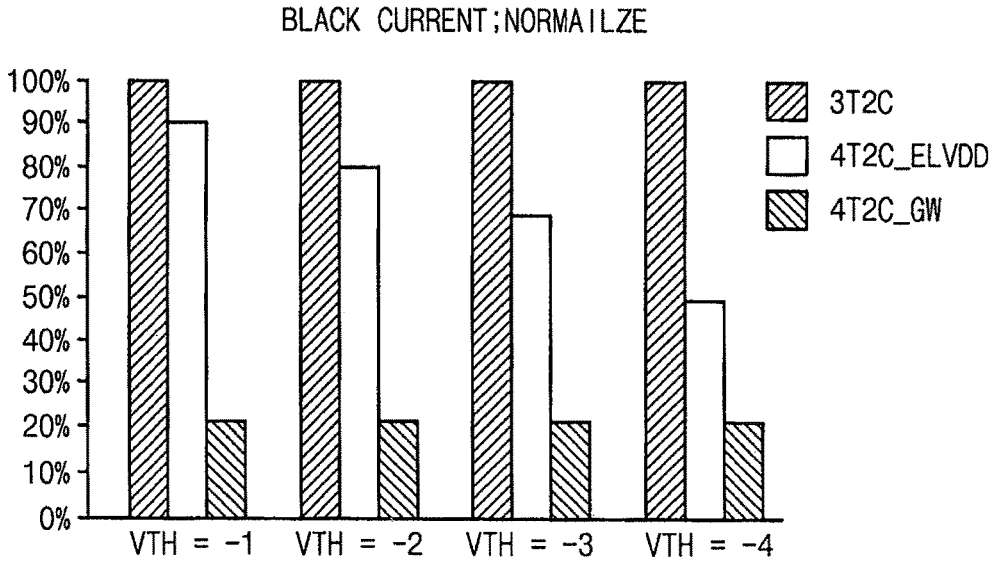
FIG. 7 is a graph diagram normalizing a current flowing through an organic light-emitting element when the sub-pixel displays a black image according to the comparative example embodiment and the exemplary embodiments.

FIG. 5 is a graph diagram illustrating a current flowing through an organic light-emitting element when the sub-pixel displays a black image according to a comparative example embodiment and exemplary embodiments of the described technology. FIG. 6 is a graph diagram illustrating a current flowing through an organic light-emitting element when the sub-pixel displays a white image according to the comparative example embodiment and the exemplary embodiments. FIG. 7 is a graph diagram normalizing a current flowing through an organic light-emitting element when the sub-pixel displays a black image according to the comparative example embodiment and the exemplary embodiments.

In reference to FIGS. 5, 6 and 7, according to a comparative example embodiment 3T2C, a sub-pixel includes three transistors TR1 , TR2 and TR3 and two capacitors Ccc and Cstg, such as the sub-pixel described in the previous exemplary embodiments, but does not include a fourth transistor TR4.

According to exemplary embodiment 1 4T2C_ELVDD, a sub-pixel includes four transistors TR1, TR3, TR2 and TR4 and two capacitors Ccc and Cstg, such as the sub-pixel described in FIG. 2. The control electrode of the fourth transistor TR4 receives the first power signal ELVDD.

According to exemplary embodiment 2 4T2C_GW, a sub-pixel includes four transistors. TR1, TR3, TR2 and TR4 and two capacitors Ccc and Cstg, such as the sub-pixel described in FIG. 3. The control electrode of the fourth transistor TR4 receives the scan signal Sn.

FIG. 5 is graph diagram illustrating a current flowing through an organic light-emitting element when the sub-pixel displays a black image according to the comparative example embodiment (3T2C), the exemplary embodiment 1 (4T2C_ELVDD) and the exemplary embodiment 2 (4T2C_GW). The graph diagram shown in FIG. 5 is divided according to a threshold voltage VTH of a transistor in the organic light-emitting display panel. A black current flows through the organic light-emitting element OLED when the sub-pixel displays the black image.

In reference to FIG. 5, the black currents according to the exemplary embodiments 1 and 2 (4T2C_ELVDD and 4T2C_GW), are reduced in comparison to the comparative example embodiment 3T2C.

However, FIG. 6 is a graph diagram illustrating a current flowing through an organic light-emitting element when the sub-pixel displays a white image according to the comparative example embodiment (3T2C), the exemplary embodiment 1 (4T2C_ELVDD) and the exemplary embodiment 2 (4T2C_GW). The graph diagram shown in FIG. 6 is divided according to a threshold voltage VTH of a transistor in the organic light-emitting display panel. A white current, that is a peak current, flows through the organic light-emitting element OLED when the sub-pixel displays the white image.

In reference to FIG. 6, white currents according to the comparative example embodiment (3T2C), and the exemplary embodiments 1 and 2 (4T2C_ELVDD and 4T2C_GW), are substantially the same as each other.

FIG. 7 is graph diagram normalizing the black currents according to the comparative example embodiment (3T2C), and the exemplary embodiments 1 and 2 (4T2C_ELVDD and 4T2C_GW). As shown in FIG. 7, the black currents of the exemplary embodiments 1 and 2 (4T2C_ELVDD and 4T2C_GW) are reduced in comparison to the black current of the comparative example embodiment (3T2C). In reference to FIG. 7, when the black current of the comparative example embodiment (3T2C) is 100%, the black current of the exemplary embodiment 1 (4T2C_ELVDD) is between about 90% to about 50% and the black current of the exemplary embodiment 2 (4T2C_GW) is about 20%. According to the exemplary embodiments 1 and 2 (4T2C_ELVDD and 4T2C_GW), the black current is reduced by about 10% to about 80% in comparison to the black current of the comparative example embodiment (3T2C). When a reduced amount of the black current is converted to a contrast ratio, the contrast ratio of the exemplary embodiments 1 and 2 (4T2C_ELVDD and 4T2C_GW) may be increased by about 1.1 times to about 4.3 times in comparison to the contrast ratio of the comparative example embodiment (3T2C).

Therefore, according to exemplary embodiments, the contrast ratio may be increased.

According to at least one of the disclosed embodiments of the described technology, the off-leakage current of the organic light-emitting element is decreased so that contrast ratio may be increased.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the accompanying claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the accompanying claims.

What is claimed is:

1. An organic light-emitting diode (OLED) display panel comprising:

a first transistor configured to receive a data signal in response to a scan signal;

a second transistor configured to receive a first power signal from a first power source in response to a bias signal and to output a source-driving signal;

a third transistor configured to receive the source-driving signal in response to an output signal of the first transistor and to output a driving signal;

an OLED which comprises i) a first electrode being electrically connected to the third transistor and configured to receive the driving signal and ii) a second electrode connected to a second power source;

a fourth transistor electrically connected to the third transistor and configured to receive the driving signal;

a first capacitor having first and second electrodes opposing each other, wherein the first electrode of the first capacitor is directly connected to the first power source, wherein the second electrode of the first capacitor is directly connected to a non-control electrode of the first transistor and a control electrode of the third transistor; and a second capacitor having first and second electrodes opposing each other, wherein the first electrode of the second capacitor is directly connected to the first power source and the first electrode of the first capacitor, and wherein the second electrode of the second capacitor is directly connected to the bias signal and a control electrode of the second transistor, wherein the fourth transistor comprises a control electrode, an input electrode and an output electrode, the input electrode being electrically connected to the third transistor, and wherein the control electrode of the fourth transistor is directly connected to the first power source and the output electrode of the fourth transistor is directly connected to a control power source different from the first power source.

2. The display panel of claim 1, wherein the control power source has a power level the same as that of the second power source.

3. The display panel of claim 1, wherein the bias signal has a level which is selectively determined depending on a dimming mode.

4. The display of claim 1, wherein the control power source is different from the second power source.

5. An organic light-emitting diode (OLED) display panel comprising:

a first transistor configured to receive a data signal in response to a scan signal;

a second transistor configured to receive a first power signal from a first power source in response to a bias signal and to output a source-driving signal;

a third transistor configured to receive the source-driving signal in response to an output signal of the first transistor and to output a driving signal;

an OLED which comprises i) a first electrode being electrically connected to the third transistor and configured to receive the driving signal and ii) a second electrode connected to a second power source;

a fourth transistor electrically connected to the third transistor and configured to receive the driving signal;

a first capacitor having first and second electrodes opposing each other, wherein the first electrode of the first capacitor is directly connected to the first power source, wherein the second electrode of the first capacitor is directly connected to a non-control electrode of the first transistor and a control electrode of the third transistor; and a second capacitor having first and second electrodes opposing each other, wherein the first electrode of the second capacitor is directly connected to the first power source and the first electrode of the first capacitor, and wherein the second electrode of the second capacitor is directly connected to the bias signal and a control electrode of the second transistor, wherein the fourth transistor comprises a control electrode, an input electrode and an output electrode, the input electrode being electrically connected to the third transistor, and wherein the control electrode of the fourth transistor is directly connected to the scan signal and the output electrode of the fourth transistor is directly connected to a control power source different from the first power source, wherein the control electrode of the fourth transistor is configured to receive the scan signal.

6. An organic light-emitting diode (OLED) display comprising:

an OLED display panel which comprises i) a first transistor being electrically connected to a gate line and a data line, ii) a second transistor configured to receive a first power signal from a first power source in response to a bias signal and to output a source-driving signal, iii) a third transistor configured to receive the source-driving signal in response to an output signal of the first transistor and to output a driving signal, iv) an OLED comprising a first electrode being electrically connected to the third transistor and configured to receive the driving signal and a second electrode connected to a second power source, and v) a fourth transistor being electrically connected to the third transistor and configured to receive the driving signal, vi) first capacitor having first and second electrodes opposing each other, wherein the first electrode of the first capacitor is directly connected to the first power source, wherein the second electrode of the first capacitor is directly connected to a non-control electrode of the first transistor and a control electrode of the third transistor, and vii) a second capacitor having first and second electrodes opposing each other, wherein the first electrode of the second capacitor is directly connected to the first power source and the first electrode of the first capacitor, and wherein the second electrode of the second capacitor is directly connected to the bias signal and a control electrode of the second transistor, wherein the fourth transistor comprises a control electrode, an input electrode and an output electrode, the input electrode being electrically connected to the third transistor, and wherein the control electrode of the fourth transistor is directly connected to the first power source and the output electrode of the fourth transistor is directly connected to a control power source different from the first power source;

a scan driver configured to provide the gate line with a scan signal; and a data driver configured to provide the data line with a data signal.

7. The display of claim 6, wherein the control power source has a power level the same as that of the second power source.

8. The display device of claim 6, wherein the bias signal has a level which is selectively determined depending on a dimming mode.

9. An organic light-emitting diode (OLED) display comprising:

an OLED display panel which comprises i) a first transistor being electrically connected to a gate line and a data line, ii) a second transistor configured to receive a first power signal from a first power source in response to a bias signal and to output a source-driving signal, iii) a third transistor configured to receive the source-driving signal in response to an output signal of the first transistor and to output a driving signal, iv) an OLED comprising a first electrode being electrically connected to the third transistor and configured to receive the driving signal and a second electrode connected to a second power source, and v) a fourth transistor being electrically connected to the third transistor and configured to receive the driving signal, vi) first capacitor having first and second electrodes opposing each other, wherein the first electrode of the first capacitor is directly connected to the first power source, wherein the second electrode of the first capacitor is directly connected to a non-control electrode of the first transistor and a control electrode of the third transistor, and vii) a second capacitor having first and second electrodes opposing each other, wherein the first electrode of the second capacitor is directly connected to the first power source and the first electrode of the first capacitor, and wherein the second electrode of the second capacitor is directly connected to the bias signal and a control electrode of the second transistor, wherein the fourth transistor comprises a control electrode, an input electrode and an output electrode, the input electrode being electrically connected to the third transistor, and wherein the control electrode of the fourth transistor is directly connected to the first power source and the output electrode of the fourth transistor is directly connected to a control power source different from the first power source;

a scan driver configured to provide the gate line with a scan signal; and a data driver configured to provide the data line with a data signal.

* * * * *